US005564203A

United States Patent [19]

Morris

[11] Patent Number: 5,564,203

[45] Date of Patent: Oct. 15, 1996

[54] INSTEP LACING COMPONENT SYSTEM

[75] Inventor: E. Scott Morris, East Providence, R.I.

[73] Assignee: Reebok International Ltd., Stoughton, Mass.

[21] Appl. No.: 570,377

[22] Filed: Dec. 11, 1995

Related U.S. Application Data

[63] Continuation of Ser. No. 288,351, Aug. 10, 1994, abandoned.

[51] Int. Cl.[6] ..... A43C 11/00

[52] U.S. Cl. ..... 36/50.1; 36/72 R; 36/136

[58] Field of Search ..... 36/96, 100, 133, 36/132, 50.1, 54, 72 R, 136, 58.5, 58.6, 51, 114, 71, 1.5; 24/712.1, 713.6, 714.1

[56] References Cited

U.S. PATENT DOCUMENTS

| | | | |
|---|---|---|---|
| 601,192 | 3/1898 | Woodside | 36/54 |
| 811,316 | 1/1906 | McPherson | 36/50.1 X |
| 1,043,888 | 11/1912 | Wilson | 36/72 R |
| 1,184,013 | 5/1916 | Pierce . | |
| 1,215,198 | 2/1917 | Rothstein | 36/54 |
| 1,255,616 | 2/1918 | Koppe | 36/54 |
| 1,663,221 | 3/1928 | Scroggins . | |
| 1,708,156 | 4/1929 | Scroggins . | |
| 3,006,086 | 10/1961 | Bird, Jr. | 36/72 R |
| 3,082,553 | 3/1963 | Wilmanns | 36/72 R |
| 3,271,888 | 9/1966 | Graham et al. | 36/72 R |
| 3,299,543 | 1/1967 | Merritt . | |
| 4,507,882 | 4/1985 | Harrell | 36/136 |
| 4,535,554 | 8/1985 | De Obaldia . | |
| 4,733,439 | 3/1988 | Gentry | 36/50.1 X |
| 4,805,321 | 2/1989 | Tonkel | 36/100 X |
| 4,811,500 | 3/1989 | Maccano . | |
| 4,823,426 | 4/1989 | Bragga | 36/136 X |
| 4,901,451 | 2/1990 | Cumin . | |
| 5,074,059 | 12/1991 | Melcher . | |
| 5,184,378 | 2/1993 | Batra | 36/50.1 X |
| 5,379,529 | 1/1995 | Smith et al. | 36/50.1 X |

FOREIGN PATENT DOCUMENTS

| | | | |
|---|---|---|---|
| 2293884 | 8/1976 | France | 36/133 |
| 2375841 | 7/1978 | France . | |
| 4403044 | 8/1994 | Germany | 36/136 |
| 0303645 | 12/1954 | Switzerland | 36/54 |
| 121573 | 12/1918 | United Kingdom . | |
| 667259 | 2/1952 | United Kingdom . | |
| 9409662 | 5/1994 | WIPO | 36/50.1 |

OTHER PUBLICATIONS

Avia Spring 1993 Catalog, Shoe Model #2075.

*Primary Examiner*—Ted Kavanaugh

*Attorney, Agent, or Firm*—Sterne, Kessler, Goldstein & Fox P.L.L.C.

[57] ABSTRACT

The invention provides a removable instep piece for a shoe. The removable instep piece is disposed in the instep region of the upper such that it is selectively removable from the shoe separately from the tongue of the shoe. The removable instep piece includes a unitary central portion and straps extending outwardly therefrom. The straps extend one each through strap openings in the upper of the shoe. Shoe laces may be passed through eyelets in the distal end of the straps of the instep piece.

19 Claims, 3 Drawing Sheets

INSTEP LACING COMPONENT SYSTEM

This application is a continuation of application Ser. No. 08/288,351, filed Aug. 10, 1994 now abandoned.

BACKGROUND OF THE INVENTION

1. Field Of the Invention

This invention relates generally to footwear and specifically to athletic footwear having a removable instep support which serves as an interchangeable support structure for the instep portion of the wearer's foot.

2. Description of the Related Art

In many sporting activities, the wearer of athletic footwear is particularly vulnerable to injury from inadequate support of the instep region of the foot. This vulnerability arises due to the potential for accidental blows from objects and individuals as well as the potential for the foot to shift within the shoe during strenuous activity. These difficulties have led to the development of athletic shoes having means to better support the instep region of the wearer's foot.

Many of the methods to provide such support involve means to secure the tongue over the instep portion of the wearer's foot. U.S. Pat. No. 3,299,543 to Merritt teaches a method for lacing the shoe whereby the lacing margin of a shoe upper and a tongue contain eyelets through which a lace passes to center the tongue over the instep of the wearer's foot. Although this design maintains alignment of the tongue over the instep, it does not provide any additional support beyond that which is already offered by the tongue.

It is also known to use straps attached to the shoe to help secure the foot of the wearer. U.S. Pat. No. 1,663,221 to Scroggins teaches a boot with straps attached to one side of an ankle support which secure through openings in the tongue and upper to one side of the upper by a buckle. Similarly, U.S. Pat. No. 1,708,156 to Scroggins teaches a boot with straps attached to one side of an ankle support which overlay the instep region of the wearer's foot and secure over the lacing margin to the opposite side of the upper by fastening means attached to the opposite side of the ankle support. U.S. Pat. No. 4,901,451 to Cumin discloses a flap which is permanently attached to the upper and covers the opening in the instep, securing to the vamp on the opposite side. British Patent 121,573 to Loud discloses a strapping system whereby a strap is integrally attached to the tongue and fastens to itself through openings in the upper. In all of the aforementioned designs, the straps are cumbersome to the wearer because they must be separately fastened to the upper while the shoe is still laced in the conventional way. In addition, because the straps are integral to the shoe, the wearer has no option but to use them.

The Avia Model 2075 Running shoe contains straps attached to the upper which pass through openings in the heel counter and secure to the shoe by holes in the ends for laces. The straps are primarily intended to provide ankle and heel support to the wearer's foot and are not removable. The Reebok Tongue Strapping System for a Shoe Upper by Smith, et. al. (U.S. Pat. No. 5,379,529 ) teaches a shoe with straps attached to the tongue which pass through openings in the upper and secure by lacing apertures in the straps. Although this design provides instep support to the wearer's foot, a major disadvantage is that because the straps are integrally attached to the tongue, the wearer does not have the option of not using the straps when securing the shoe laces. An additional disadvantage is that the straps are not interchangeable with other straps.

Attempts have been made to employ separate devices to provide support to the wearer's foot as well. U.S. Pat. No. 4,811,500 to Maccano discloses a shoe having straps secured to a sling member which underlies the foot of the wearer. The straps extend upwardly and exit the shoe at openings near the lacing portion, where they are fastened together by lacing or other means. By providing support to the instep portion of the foot from below, the design has a major disadvantage by not providing protection to the top of the instep of the wearer's foot. U.S. Pat. No. 1,184,013 to Pierce discloses a shoe-cushion-hood system whereby a cushion designed to overlay the instep portion of the shoe opening adjacent to the lacing margin can be fastened to the upper by lacing. The cushion may be protected by a separate or integral hood member which overlays the cushion and fastens to the shoe upper on the lateral and medial sides. While the hood and cushion system together provide support to the instep of the wearer's foot, a major disadvantage of this design is that the cushion and the hood, together or separately, require both lacing and other means to attach to the shoe, making the system both cumbersome and unsightly.

Accordingly, prior to the development of the present invention, no shoe existed which integrated a single, removable, interchangeable, and simply attached member to provide protection and support to the instep portion of the foot of the wearer.

Therefore, it is an object of the present invention to provide an athletic shoe having additional support in the instep region of the foot of the wearer.

It is a further object of the present invention to provide an athletic shoe which provides such instep support in an interchangeable and removable yet simply attached support piece which adds to the support of the shoe without detracting from the shoe's appearance.

SUMMARY OF THE INVENTION

To achieve the foregoing and other objects, and in accordance with the purposes of the present invention, as embodied and broadly described herein, the shoe of the present invention comprises an upper which has an ankle opening defining a lacing margin in an instep region which includes eyelets for receiving a shoe lace, and an opening adjacent to the lacing margin. A tongue is disposed in the upper. A removable instep support is disposed on the upper above the instep region. A strap is disposed on the removable instep support, and an eyelet is defined in the strap. The strap extends through the opening in the instep region and a shoe lace is threaded through the eyelets in the upper and the strap to secure the shoe about the foot of a wearer.

The shoe may further comprise a second strap disposed on the removable instep support opposite the first strap. The shoe may further comprise a third strap disposed on the removable instep support adjacent to the second strap. The shoe may further comprise a fourth strap disposed on the removable instep support opposite the third strap.

The shoe may further comprise a second opening defined in the upper adjacent to the lacing margin and opposite to the first opening. The shoe may further comprise a third opening in the upper adjacent to the lacing margin opposite to the second opening. The shoe may further comprise a fourth opening defined in the upper adjacent to the lacing margin opposite to the third opening.

The shoe may further comprise a second eyelet defined in the second strap which extends through the second opening in the instep region and a shoe lace is threaded through the eyelets in the upper and the second strap. The shoe may further comprise a third eyelet defined in the third strap which extends through the third opening in the instep region and a shoe lace is threaded through the eyelets in the upper and the third strap. The shoe may further comprise a fourth eyelet defined in the fourth strap which extends through the fourth opening in the instep region and a shoe lace is threaded through the eyelets in the upper and the fourth strap.

The instep support may also have a top surface and an opposing bottom surface, and the instep support may be reversible so that it may be disposed on the upper above the tongue with either the top or bottom surface disposed against the tongue.

Alternatively, the shoe of the present invention comprises an upper which has an ankle opening defining a lacing margin in an instep region which includes eyelets for receiving a shoe lace, an opening adjacent to the lacing margin, and a second opening defined in the upper adjacent to the lacing margin and opposite the first opening. A tongue is disposed in the upper. A removable instep support is disposed on the upper above the instep region. A strap is disposed on the removable instep support, and an eyelet is defined in the strap. The strap extends through the opening in the instep region and a shoe lace is threaded through the eyelets in the upper and the strap. A second strap is disposed on the removable instep support, and a second eyelet is defined in the second strap. The second strap extends through the opening in the instep region and a shoe lace is threaded through the eyelets in the upper and the second strap.

The shoe may further comprise a third strap disposed on the removable instep support adjacent to the second strap. The shoe may further comprise a fourth strap disposed on the removable instep support opposite the third strap.

The shoe may further comprise a third opening in the upper adjacent to the lacing margin opposite to the second opening. The shoe may further comprise a fourth opening defined in the upper adjacent to the lacing margin opposite to the third opening.

The shoe may further comprise a third eyelet defined in the third strap which extends through the third opening in the instep region and a shoe lace is threaded through the eyelets in the upper and the third strap. The shoe may further comprise a fourth eyelet defined in the fourth strap which extends through the fourth opening in the instep region and a shoe lace is threaded through the eyelets in the upper and the fourth strap.

The instep support may also have a top surface and an opposing bottom surface, and the instep support may be reversible so that it may be disposed on the upper above the tongue with either the top or bottom surface disposed against the tongue.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

The accompanying drawings illustrate a shoe incorporating an instep support system of the present invention. The instep support system provides additional support to the instep region of an athletic shoe by incorporating an interchangeable and removable, yet simply attached instep support piece which adds to the support of the shoe without detracting from the shoe's appearance.

Figure 1:
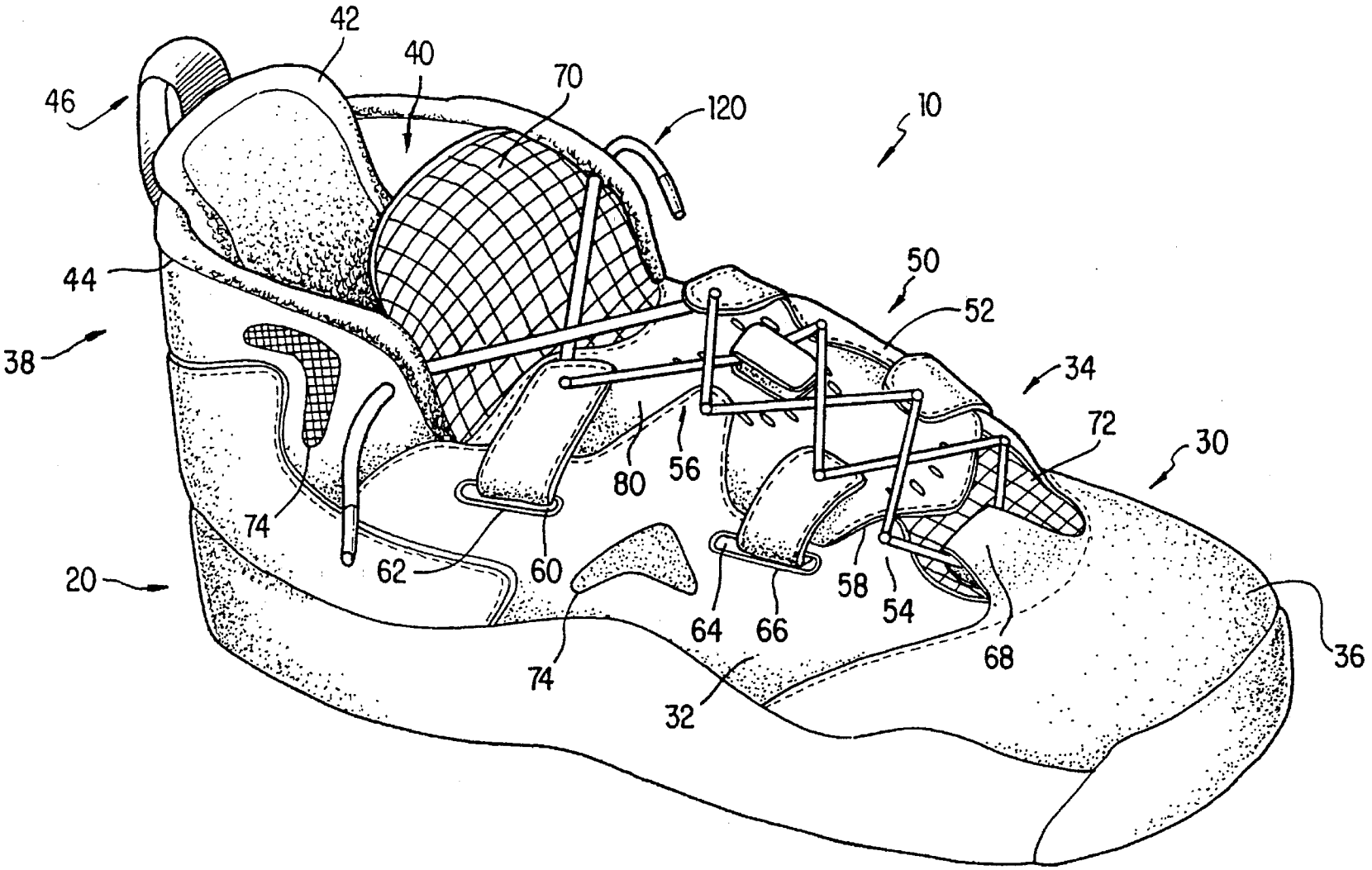
FIG. 1 is a perspective view of the medial side of a shoe for the left foot in accordance with the present invention.
Figure 2:
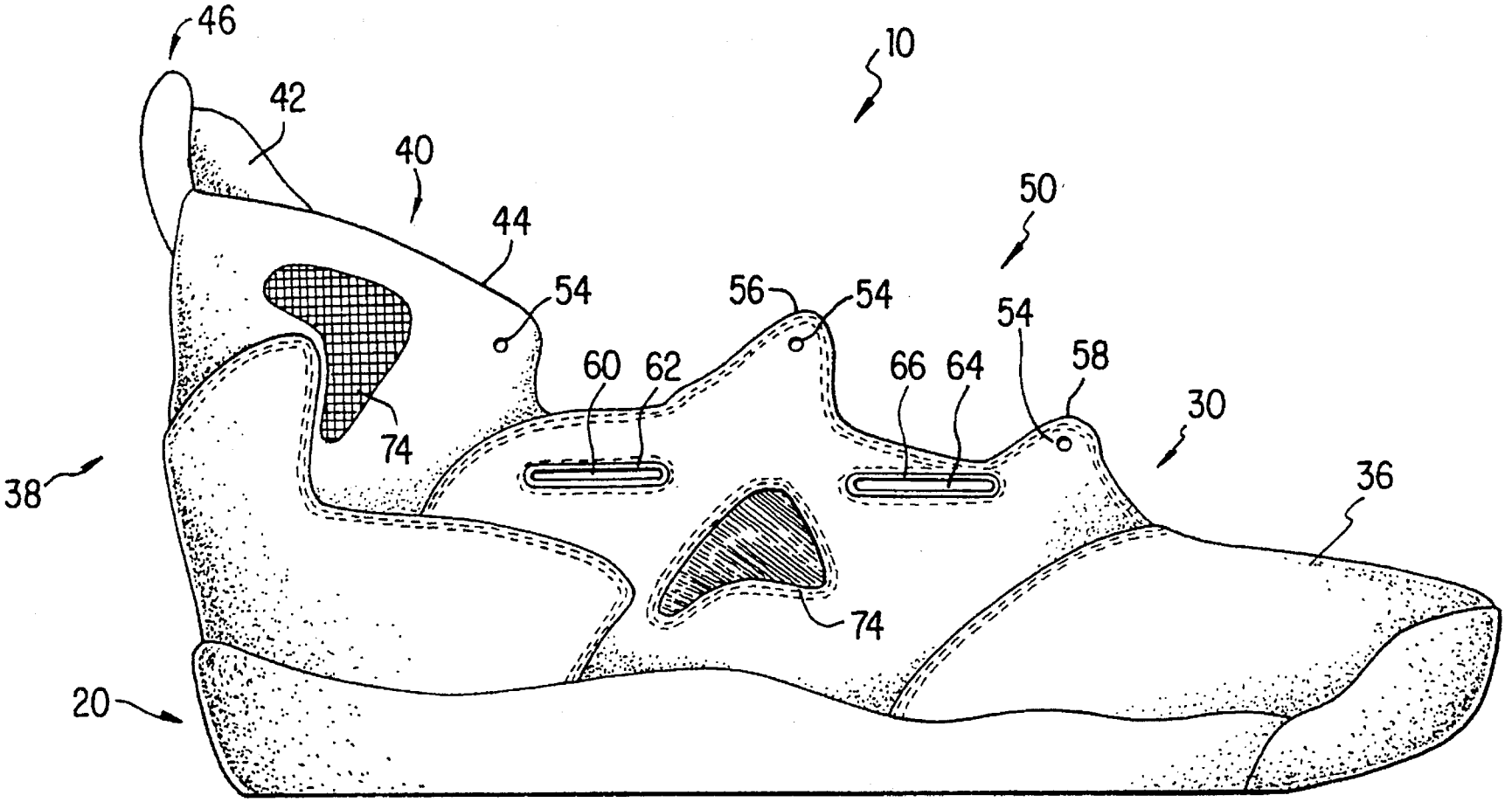
FIG. 2 is a lateral plan view of a shoe in accordance with the present invention.

Referring to the accompanying drawings, FIG. 1 is a perspective view of the medial side of a shoe 10 in accordance with the present invention. Although FIG. 1 and FIG. 2 depict the instep support system on a shoe 10 for the left foot, it is understood that the instep support system of the present invention encompasses a shoe for the right foot as well. FIG. 2 is a plan view of the lateral side of shoe 10. Shoe 10 includes a sole 20 of conventional materials and construction and an upper, designated generally as 30. Upper 30 is attached to sole 20 by any conventional lasting technique, including cement lasting.

Shoe upper 30 encompasses the foot of a person wearing shoe 10, while shoe sole 20 provides support and cushioning therefor. Shoe upper 30 may be made of any suitable material including leather or synthetic leather and includes a medial side 32 and a lateral side 34. Shoe upper 30 further includes a toe region 36 and a heel region 38 which is disposed rearwardly of shoe upper 30 opposite to toe region 36. Instep region 50 is disposed between toe region 36 and heel region 38. An ankle opening 40 through which the foot is inserted into shoe 10 is provided in the top portion of upper 30 opposite to sole 20. An ankle support 42 is disposed in ankle opening 40. A traditional padded ankle collar 44 is disposed about the rear of ankle opening 40. A back strap 46 is connected to ankle collar 44 and to heel region 38 of upper 30. Ankle support 42 is attached to upper 30 by any conventional technique.

Instep region 50 includes lacing margin 52 which defines a portion of ankle opening 40. Lacing margin 52 is provided with six eyelets 54 (three on each side of lacing margin 52) for receiving a conventional shoe lace 120, as shown in FIG. 1. Both sides of lacing margin 52 are symmetrical and include an upper lacing margin extension 56 and a lower lacing margin extension 58 which extend from lacing margin 52. Disposed adjacent to lacing margin 52 and between ankle opening 40 and upper lacing margin extension 56 on both medial side 32 and lateral side 34 of upper 30 is an opening 60. A reinforcement 62 lines upper opening 60 to prevent stresses from causing tearing of opening 60 when a strap, as described below, is inserted therethrough. Reinforcement 62 is preferably made of nylon, or any other strong and abrasion-resistant material. In a likewise fashion, an opening 64 is disposed adjacent to lacing margin 52 and between upper lacing margin extension 56 and lower lacing margin extension 58 on both medial side 32 and lateral side 34 of upper 30. Opening 64 is also lined with a reinforcement 66 to prevent tearing as discussed above. Openings 60 and 64 are oval shaped and are approximately 22 mm wide. A lacing loop 68 is provided at the forward most edge of lacing margin 52 nearest toe region 36 and also receives shoe lace 120 when upper 30 is secured about the foot of a wearer.

The present invention further includes a conventional tongue 70 disposed within upper 30 at lacing margin 52. Tongue 70 is secured within upper 30 adjacent to toe region 36. Tongue 70 includes a top surface 72 against which instep support 80 is disposed.

Air vents 74 are disposed about upper 30 on both medial side 32 and lateral side 34. Vents 74 are mesh covered and allow air to circulate into the interior of upper 30.

Figure 4:
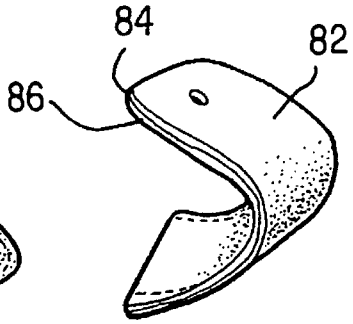
FIG. 4 is a perspective view of the instep support strap in accordance with the present invention.
Figure 3:
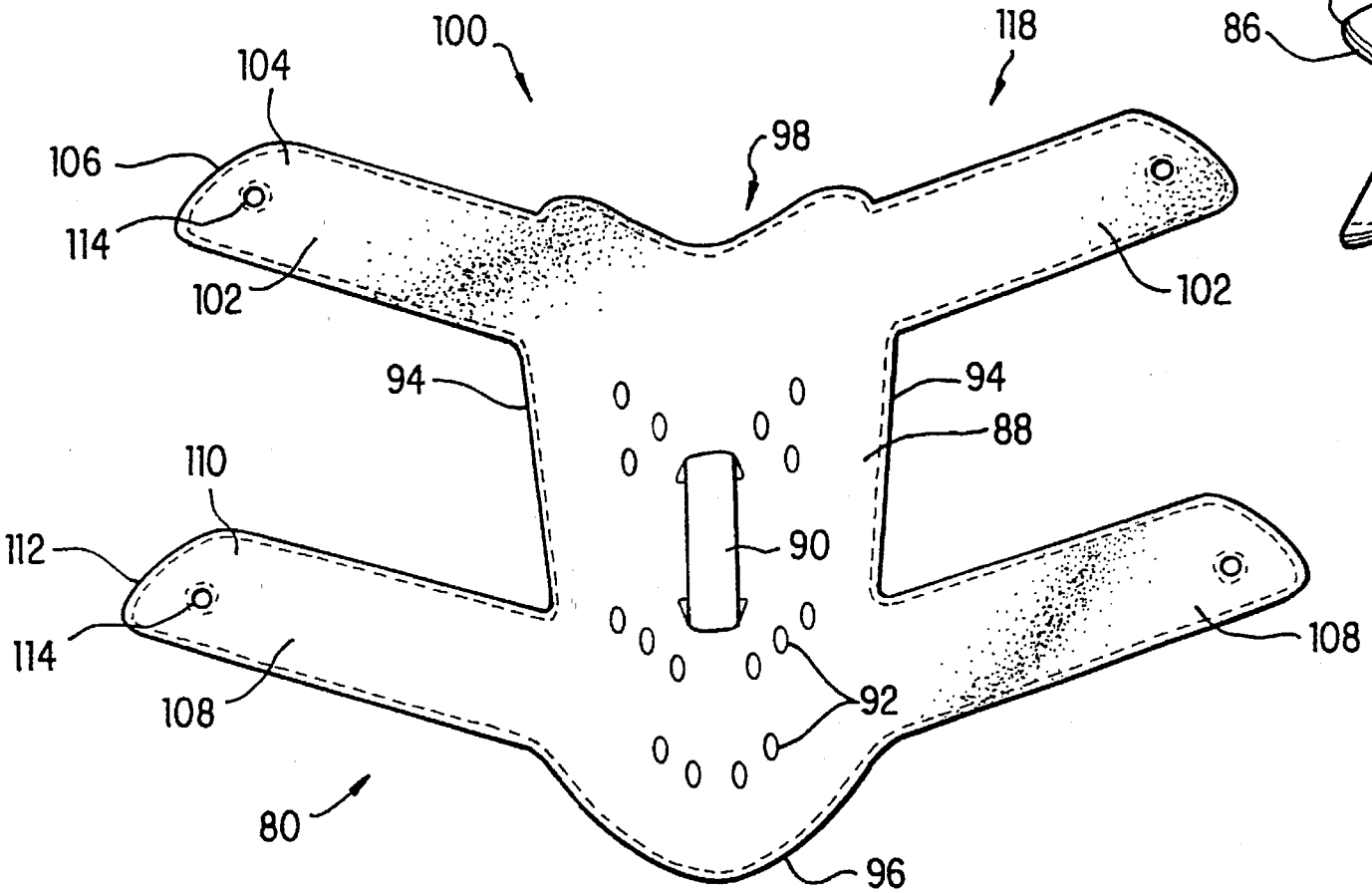
FIG. 3 is a top view of the instep support in accordance with the present invention.

Additional support is provided to the foot of a wearer of shoe 10 through instep support piece 80, as shown separately in FIGS. 3 and 4, and in place in shoe 10 in FIG. 1. Instep support 80 is preferably comprised of three layers of material, a backer 82, a substrate 84, and a surface layer 86 which are stitched or otherwise secured to each other. The total thickness of support 80 is preferably 1.4 to 1.5 min. Backer 82, substrate 84 and surface layer 86 are each preferably constructed of synthetic polyurethane, for which each surface layer 86 and backer 82 is pressed and buffed. Surface layer 86 and backer 82 each may also be constructed of any other suitable synthetic or natural material such as leather, which is flexible yet supportive.

Support 80 includes a unitary central portion 88 and straps 102 and 108. Disposed on both surface layer 86 and backer 82 of central portion 88 is lace guide 90 through which shoe lace 120 passes to maintain instep support 80 in instep region 50. Through holes 92 may be provided in central portion 88 of instep support 80 to reduce the weight of support 80, as well as to permit air circulation. Central portion 88 of instep support 80 is partially defined by side edges 94 which are substantially parallel to the each other. Support 80 also has a curved front edge 96 which is substantially parallel to a curved rear edge 98.

Oppositely disposed on medial side 100 and lateral side 118 of instep support 80 is an upper strap 102 and a lower strap 108. The end 104 of upper strap 102 includes a distal end 106 in which is disposed an eyelet 114 for receiving a shoe lace 120. In a likewise fashion, end 110 of lower strap 108 includes a distal end 112 in which is disposed an eyelet 114 for receiving a shoe lace 120. Upper straps 102 and lower straps 108 extend outwardly from central portion 88 of instep support 80 and are substantially parallel to one another and are of similar length. The upper strap 102 and lower strap 108 are approximately 21 mm wide and their cross-sections are slightly smaller than upper opening 60 and lower opening 64 of shoe upper 30 so that they may be inserted therethrough as described below.

In order to fully appreciate the present invention, the implementation of the instep support system utilized in accordance with the present invention will now be described, as applied to the preferred embodiment of the present invention set forth above. Before placing a foot in shoe 10, the wearer threads upper straps 102 and lower straps 108 of instep support 80 through upper opening 60 and lower opening 64, respectively, as shown in FIG. 1. The threading may be accomplished such that either backer 82 or surface layer 86 of instep support 80 rests upon top surface 72 of tongue 70. After the foot is inserted through ankle opening 40, upper strap end 104 of upper strap 102 and lower strap end 110 of lower strap 108 are pulled outwardly from the interior of the shoe upper 30 and folded over themselves, as shown in FIG. 4, until eyelets 114 disposed on straps 102 and 108 are substantially aligned with eyelets 54 of lacing margin 52. Shoe lace 120 is laced through lacing loop 68, eyelets 114 on lower strap 108, eyelets 54 on lacing margin 52, lace guide 90 on central portion 88 of instep support 80, and eyelets 114 on upper strap 102. As shoo lace 120 is tightened, each of straps 102 and 108 as well as medial side 32 and lateral side 34 of upper 30 are drawn toward one another, creating tension with shoo upper 30. This has the effect of creating additional support to the instep region of the wearer's foot, protecting the wearer from injury during athletic activity that might otherwise occur either by direct contact with other persons, equipment or obstacles during athletic competition, or by shifting of the wearer's foot within shoe 10 due to inadequate support.

An additional feature of instep support 80 is that it may be reversible such that where backer 82 and surface layer 88 are comprised of different material, color, or texture, two different appearances may be achieved in the same shoe 10 or in a pair of shoes. Furthermore, instep support 80 is removable and interchangeable with other instep supports of similar configuration. Therefore, if support 80 becomes damaged, the wearer can simply replace it for a new support. Shoe 10 is constructed so that it may alternatively be worn without instep support 80 by simply lacing eyelets 54 of lacing margin 52. These features thus provide the wearer with several options in utilizing a shoe 10 equipped with such instep support 80 so that the functional as well as stylistic needs of the wearer are met.

The foregoing description of the preferred embodiment of the invention has been presented for purposes of illustration and description. It is not intended to be exhaustive or to limit the invention to the precise form disclosed, and obviously many modifications and variations are possible in light of the above teachings. For example, while the shape of upper lacing margin extension edge 56 and lower lacing margin extension edge 58 shown in FIG. 1 and FIG. 2 take on a pointed appearance, edges which take on a significantly different appearance may be used. In addition, while openings 60 and 64 are shown to be substantially oval shaped, they may be of a different shape which would permit straps 102 and 108 to be inserted therethrough.

Furthermore, although an instep support 80 having is shown in the FIGS. as having only four straps, any number of straps may be used. For example, if a high top shoe, rather than a low or mid height shoe as shown in FIG. 1 is used, six straps (three on each side) may be preferable.

It is anticipated that the preferred embodiment described above will be most effective in shoes which are intended for athletic activity, such as basketball, running, aerobics, soccer, and tennis. Accordingly, although the figures show what would typically be considered a basketball shoe, the present invention is equally suited for incorporation into other types of footwear.

The preferred embodiment was chosen and described in order to best explain the principles of the present invention and its practical application to thereby enable others skilled in the art to best utilize the invention in various embodiments and with various modifications as are suited to the particular use contemplated. It is intended that the scope of the invention be defined by the claims appended hereto.

What I claim is:

1. A shoe comprising:

an upper defining an ankle opening and having an instep region;

a lacing margin in said instep region of said upper, wherein said lacing margin defines a portion of said ankle opening;

a strap opening disposed in said upper adjacent to said lacing margin;

a tongue disposed in and secured to said upper;

a removable instep piece disposed on said upper adjacent to and separate from said tongue in said instep region of said upper whereby said removable instep piece is selectively removable from said shoe separately from said tongue;

a strap disposed on said removable instep piece, wherein said strap extends through said strap opening in said upper from an interior of said upper to an exterior of said upper such that a distal end of said strap is disposed on the exterior of said upper; and an eyelet disposed in said distal end of said strap for receiving a shoe lace.

2. A shoe according to claim 1, further comprising:

a second strap disposed on said removable instep piece opposite to said first strap.

3. A shoe according to claim 2, further comprising:

a second trap opening defined in said upper adjacent to said lacing margin opposite to the first strap opening, wherein said second strap extends through said second strap opening from the interior of said upper to the exterior of said upper such that a distal end of said second strap is disposed on the exterior of said upper.

4. A shoe according to claim 3, further comprising:

a third strap disposed on said removable instep piece adjacent to said second strap; and a fourth strap disposed on said removable instep piece opposite to said third strap.

5. A shoe according to claim 4, further comprising:

a third eyelet defined in a distal end of said third strap; and a fourth eyelet defined in a distal end of said fourth strap.

6. A shoe according to claim 4, further comprising:

a third strap opening defined in said upper adjacent to said lacing margin adjacent to said second strap opening, wherein said third strap extends through said third strap opening from the interior of said upper to the exterior of said upper such that a distal end of said third strap is disposed on the exterior of said upper; and a fourth strap opening defined in said upper adjacent to said lacing margin opposite to said third strap opening, wherein said fourth strap extends through said fourth strap opening from the interior of said upper to the exterior of said upper such that a distal end on said fourth strap is disposed on the exterior of said upper.

7. A shoe according to claim 2, further comprising:

a second eyelet defined in said distal end of said second strap.

8. A shoe according to claim 7, further comprising:

a shoe lace, wherein said shoe lace passes through at least one of said first and second eyelets.

9. The shoe of claim 1, wherein said instep piece has a top surface and an opposing bottom surface and said instep piece is reversible such that said instep piece is configured so that it may be disposed on said upper above said tongue with one of said top surface and said bottom surface disposed against said tongue.

10. A shoe comprising:

an upper defining an ankle opening and having an instep region;

a lacing margin in said instep region of said upper, wherein said lacing margin defines a portion of said ankle opening;

a first pair of strap openings disposed in a first side of said upper adjacent to said lacing margin;

a second pair of strap openings disposed in a second side of said upper adjacent to said lacing margin;

a tongue disposed in and secured to said upper;

a removable instep piece disposed on said upper adjacent to and separate from said tongue in said instep region of said upper whereby said removable instep piece is selectively removable from said shoe separately from said tongue, wherein said removable instep piece includes a unitary central portion;

a first pair of straps extending outwardly from a first side of said unitary central portion; and a second pair of straps extending outwardly from a second side of said unitary central portion, wherein said first pair of straps extend one each through each of said first pair of strap openings in said upper from an interior of said upper to an exterior of said upper such that a distal end of each of said first pair of straps is disposed on the exterior of said upper and said second pair of straps extend one each through each of said second pair of strap openings in said upper to the exterior of said upper such that a distal end of each of said second pair of straps is disposed on the exterior of said upper.

11. A shoe according to claim 10, further comprising:

a fastening means for fastening said removable instep piece in said upper, said fastening means being defined in the distal end of each of said first pair of straps and said second pair of straps.

12. A shoe according to claim 11, wherein said fastening means comprises an eyelet.

13. A shoe according to claim 12, further comprising:

a shoe lace, wherein said shoe lace passes through at least one said eyelet.

14. The shoe according to claim 10, wherein said instep piece has a top surface and an opposing bottom surface and said instep piece is reversible such that said instep piece is configured so that it may be disposed on said upper above said tongue with one of said top surface and said bottom surface disposed against said tongue.

15. A shoe comprising:

an upper defining an ankle opening and having an instep region;

a lacing margin in said instep region of said upper, wherein said lacing margin defines a portion of said ankle opening;

a strap opening disposed in said upper adjacent to said lacing margin;

a tongue disposed in and secured to said upper;

a removable instep piece disposed on said upper adjacent to and separate from said tongue in said instep region of said upper whereby said removable instep piece is selectively removable from said shoe separately from said tongue, wherein said removable instep piece includes a unitary central portion having a top surface and an opposing bottom surface, wherein said top surface of said unitary central portion is disposed against an interior surface of said upper adjacent said lacing margin; and a strap extending outwardly from said unitary central portion of said removable instep piece, wherein said strap extends through said strap opening and a distal end of said strap overlays said top surface of said central portion of said removable instep piece when said removable instep piece is in a secured position.

16. A shoe according to claim 15, further comprising:

a fastening means for fastening said removable instep piece in said upper, said fastening means being defined at said distal end of said strap.

17. A shoe according to claim 16, wherein said fastening means comprises an eyelet passing through said distal end of said strap.

18. A shoe according to claim 15, further comprising:

a second strap opening disposed in said upper adjacent to said lacing margin; and a second strap extending outwardly from said unitary central portion of said removable instep piece, wherein said second strap extends through said second strap opening and a distal end of said second strap overlays said top surface of said central portion of said removable instep piece when said removable instep piece is in a secured position.

19. A shoe according to claim 18, further comprising:

at least a third and fourth strap opening disposed in said upper adjacent to said lacing margin; and at least a third and fourth strap extending outwardly from said unitary central portion of said removable instep piece, wherein said third and fourth straps extend, respectively, one each through each of said third and fourth strap openings and a distal end of each of said third and fourth straps overlay said top surface of said central portion of said removable instep piece when said removable instep piece is in a secured position.

* * * * *

UNITED STATES PATENT AND TRADEMARK OFFICE

CERTIFICATE OF CORRECTION

PATENT NO. : 5,564,203

DATED : October 15, 1996

INVENTOR(S) : E. Scott Morris

It is certified that error appears in the above-indentified patent and that said Letters Patent is hereby corrected as shown below:

Column 7, line 15 after second, delete "trap" and substitute --strap-- therefor.

Signed and Sealed this

Thirty-first Day of December, 1996

*Attest:*

Bruce Lehman

BRUCE LEHMAN

*Attesting Officer*

*Commissioner of Patents and Trademarks*